8-110 SR
FIP8309 XR 4,303,542

United States Patent [19]
Heinlein et al.
[11] 4,303,542
[45] Dec. 1, 1981

[54] POWDERED DETERGENT OR SOAK

[76] Inventors: Karl H. Heinlein, Alte Bahnhofstr. 33; Joachim Busch, Postr. 6, both of 6490 Schluchtern, Fed. Rep. of Germany

[21] Appl. No.: 57,202

[22] Filed: Jul. 13, 1979

[30] Foreign Application Priority Data

Apr. 23, 1979 [DE] Fed. Rep. of Germany ..... 2916416

[51] Int. Cl.[3] ..... C11D 3/08; C11D 3/15; C11D 11/00; C11D 17/02

[52] U.S. Cl. ..... 252/91; 8/110; 8/137; 252/89.1; 252/90; 252/105; 252/133; 252/135; 252/136; 252/142; 252/156; 252/174; 252/174.13; 252/174.14; 252/174.21; 252/174.23; 252/174.24

[58] Field of Search ..... 8/26, 27, 28, 29, 137, 8/110; 252/90, 91, 135, 136, 142, 156, 174, 174.13, 174.21, 174.23, 174.24, 105, 89.1, 133

[56] References Cited

U.S. PATENT DOCUMENTS

| | | | |
|---|---|---|---|
| 2,817,606 | 12/1957 | Barrett | 134/22 |
| 3,042,621 | 7/1962 | Kirschenbauer | 252/99 |
| 3,516,937 | 6/1970 | Story | 252/110 |
| 3,761,415 | 9/1973 | Gould | 252/132 X |
| 3,817,870 | 6/1974 | Weiss | 252/135 |
| 3,968,048 | 7/1976 | Bolan | 252/157 |
| 4,093,417 | 6/1978 | Heinlein | 8/137 |

FOREIGN PATENT DOCUMENTS

| | | | |
|---|---|---|---|
| 1000628 | 11/1976 | Canada | 252/90 |

*Primary Examiner*—Dennis L. Albrecht
*Attorney, Agent, or Firm*—Whittemore, Hulbert & Belknap

[57] ABSTRACT

A powdered detergent suitable for use in home laundry machines contains (1) an acid component which provides an initial wash solution with a pH of 1–4 and (2) a coated alkali-supplying substance which neutralizes the acid wash solution within a period of about 2 to 25 minutes. The compositions may be free of phosphates and avoid the problem of ash build-up on fabrics usually caused by carbonate-based non-phosphate detergents.

10 Claims, 2 Drawing Figures

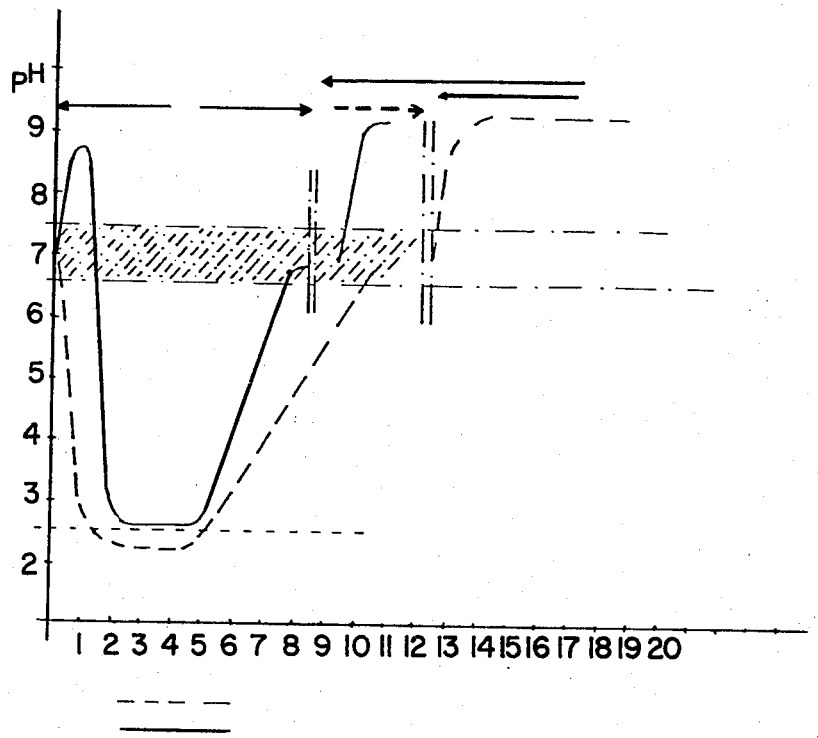
FIG. 2
FIG. 1
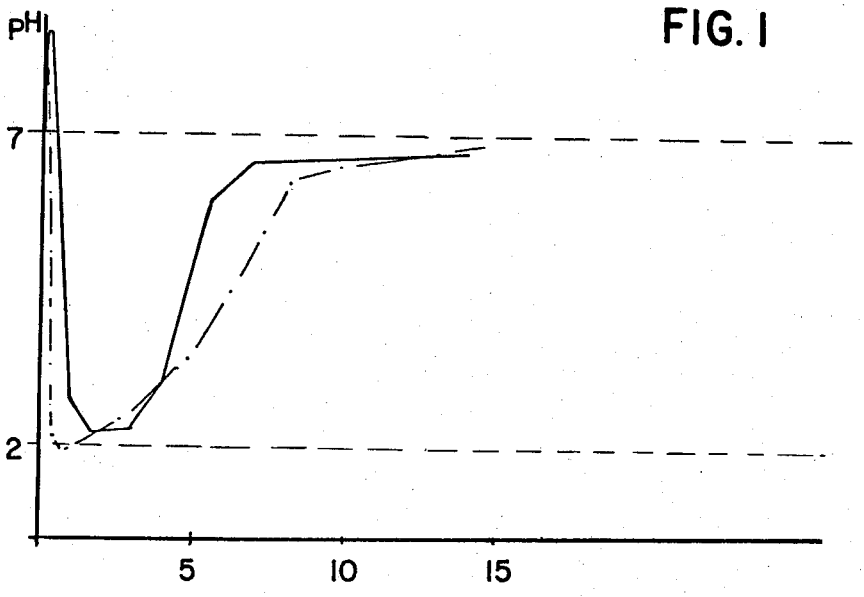

POWDERED DETERGENT OR SOAK

The invention concerns a powdered detergent or soak, particularly for use in household machines and/or for washing in a phosphate-free wash liquor, which detergent forms with water an acid wash liquor with a pH of 1–4, and which contains one or more solid or pseudosolid acids, in addition to wash-active substances.

Soaks yielding an acid soaking solution are known (see DOS Nos. 2 437 173 and 2 509 381). These are used in industrial laundries, but also in household washing machines in combination with a detergent forming a phosphate-free wash liquor, particularly a soda-containing detergent.

The washing process based on these detergents permits the clean washing of industrial laundry or household laundry with water of any degree of hardness, even without softening and does not lead to an increase of the ash content over 1.0 to 0.3%, despite the artificial production of incrustations on the fibers in the main washing cycle or after any number of washings, it permits complete elimination of phosphates without any loss of the washing power, and requires no additions of zeolite or similar phosphate substitutes (like inorganic builders).

As described in the above-mentioned DOS, a problem in this washing process - particularly in household washing machines - is the treatment of the acid waste water. In this patent it is suggested to use the soaking solution first with only a small liquid portion relative to the laundry. After the laundry has been fully saturated with the soaking solution, additional liquid and an alkali supplier is added so that the liquid is removed after an intermediate washing cycle for the first time as alkaline waste water. The required triple addition of the detergent presents no problem from a technical or practical viewpoint. But it was found in practice that it is not accepted by the housewife who is used to the two-stage method.

For this reason the above-mentioned patent already mentions the possibility of adding the alkali-supplier in micro-encapsulated form in such a way it acts only after a brief acid washing phase.

The object of the invention is to provide a powdered detergent or soak for a single-stage or two-stage washing method in conventional household washing machines, with which pH-values of 1–4, which are characteristic of the washing method in question, can be reliably achieved, and where the wash liquor is substantially or completely neutralized or alkalized after a preselectable period of time—possibly without loss of washing power—and can be removed as waste water without damage.

This problem is solved according to the invention in this way that the detergent contains powdered portions by means of which the acid wash liquor is substantially or completely neutralized or alkalized by itself within a period of about 2 to 25 minutes, and that these portions comprise one or more alkali-supplying substances from the group: sodium metasilicate, soda, waterglass, calcium oxide, magnesium oxide, magnesium oxychloride, calcium carbonate and/or magnesium carbonate, which substances are coated at least partly, but preferably completely with a film that dissolves slowly in the acid wash liquor or with a coat of a non-ionic surfactant.

As acid formers in the detergent can be used various solid acids, e.g. sodium bisulfate, amidosulfonic acid, citric acid, etc., or pseudo-solid acids (these are liquid acids bound to amorphous or spherical particles with a $SiO_2$-content of over 99.8%, known under the trade name "aerosil".

Suitable alkali-suppliers are soda or waterglass or sodium metasilicate. Particularly suitable, however, are magnesium oxide, magnesium carbonate, calcium carbonate or calcium oxide. These can be used separately or in a mixture.

Suitable as film-formers are substances which are difficultly to medium difficultly soluble in water, particularly in an acid water solution, e.g. methyl-cellulose, carboxymethyl cellulose, etc. These film-formers are better suitable in some cases in combination with the preferred wash-active coating materials for the alkali-suppliers. The film-former can be arranged on the outside or between the wash-active coat and the alkali-supplier. The course of the time-variable pH-curve can be influenced in a simple manner by such a combination.

Particularly suitable as wash-active coating substances are non-ionic surfactants, like the ethylene oxide adducts of natural or synthetic fat alcohols with varying degrees of ethoxylation between 3 and 25, or of nonylphenol with degrees of ethoxylation between 3 and 15.

In order to be able to remove protein stains, e.g. in the laundry, it may be advisable to add to the soak a rapidly dissolving anionic surfactant or an alkali-supplier which allows the pH-value to rise briefly until this value drops rapidly to the high acid range by releasing the acid. Particularly suitable for this purpose is sodium dodecyl benzene sulfonate or soap.

It is desirable that the pH-value of the soaking solution drops within 1 to 2 minutes to 1 to 4, preferably to about 2.5, and maintains this value for a period of 1 to 6 minutes, preferably 1.5 to 3 minutes. Then the pH-value rises within the next 5 to 25 minutes to a value of 5.5 to 8, preferably at least to 6.5. The course of the measured variation curves of the pH-value is shown in FIG. 1. FIG. 2 shows schematically the course of the curve for a washing cycle including the start of the main or boil washing cycle.

The preferred portions of the preferred ingredients in % by weight, related to the total mixture of the soak, result from the following table.

TABLE 1

| | Range | Preferred |
|---|---|---|
| a. sodium bisulfate | 45–80 | 59–68 |
| b. magnesium carbonate | 8–25 | 11–20 |
| c. magnesium oxide | 0–13 | 5–8 |
| d. calcium carbonate | 0–13 | 5–8 |
| e. non-ionic surfactants | 2–30 | 4–20 |
| f. anionic surfactants | 0–10 | 0–10 |

Additionally or instead of the anionic surfactants can also be used enzymes which are active in the acid range.

The hardness of the water used is practically completely uncritical.

The main detergent should be phosphate-free detergent which contain soda. But the new detergent can also be used in the main washing cycle. In particular, however, it is also possible to use only one washing cycle with the new detergent, as it is customary, for example, for fine laundry.

Sodium dodecyl, benzene sulfonate, which can be used, if necessary, as an anionic surfactant, is commercially available with a 90% active content, for example, under the designation BW 7380 from Huels. If this surfactant is used, the free acid is formed after an initial pH-rise. During this time the film former or the coating substance dissolves slowly so that the alkali-suppliers come gradually in contact with the wash solution and let the pH-rise again, with the formation of difficultly soluble or insoluble Ca-salts. These salts are deposited as emulsifiers preferably on hydrophobic stains, or dissolve in the latter. In the main washing cycle is then formed during the boiling with soda in situ the wash-active Na-salt, which then washes away the broken up stain.

EXAMPLE 1

The soak had the following composition:

110 g sodium bisulfate (63.22% by weight 31 g magnesium carbonate (17.82% by weight)

31 g Lutensol AP (17.82% by weight)

2 g BW 7380 (1.14% by weight)

Lutensol is a non-ionic water-soluble surfactant based on various highly ethoxylated starting materials, like nonylphenol, alcohols and others (it is a brand name of BASF).

EXAMPLE 2

The soak consists of:

110 g sodium bisulfate 20 g magnesium carbonate 30 g non-ionic surfactants in a ratio of liquid to solid of 1:3

13 g BW 7380

Conventional techniques can be used for the production of the soak. By spraying with non-ionic surfactants, a powdered premix is produced from magnesium carbonate, magnesium oxide, calcium carbonate. The non-ionic surfactants can be a mixture of different non-ionic surfactants. The non-ionic surfactants are preferably preheated to a temperature of 40 deg. C. or more before the spraying, but it is also possible to mix first all solid ingredients, and then spray them together with surfactants.

Subsequently the sodium bisulfate is added and the anionic surfactant, as far as the latter is used.

We claim:

1. Powdered detergent or soak particularly for use in one of a preliminary and main washing cycle of household machines and laundry machines for washing in a phosphate-free wash liquor, which detergent forms with water an acid wash liquor with a pH of 1–4, and contains one or more solid or pseudo-solid acids, in addition to wash-active substances, characterized in that the detergent contains powdered portions, by means of which the acid wash liquor is neutralized or alkalized substantially or completely by itself within a period of about 2 to 25 minutes, and that these portions comprise one or more alkali-supplying substances from the group: sodium metasilicate, soda, water-glass, calcium oxide, magnesium oxide, magnesium oxychloride, calcium carbonate and magnesium carbonate, which substances are at least partly coated with one of a film that dissolves in the acid wash liquor and a non-ionic surfactant, wherein the detergent or soak specifically includes as at least part of the alkali supplying substance 8–25% by weight magnesium carbonate, 1–13% by weight magnesium oxide and 0–20% by weight calcium carbonate.

2. Detergent or soak according to claim 1, wherein the coating is 2–25% by weight non-ionic surfactants.

3. Detergent or soak according to claim 1, characterized in that the portion of anionic surfactants is 0 to 10% by weight.

4. Detergent or soak according to claim 1, characterized in that it contains about 0.5 to about 3% of one of sodium bisulfite and sodium pyrosulfite as an acid reductive bleaching agent.

5. Detergent or soak according to claim 1, characterized in that the portion of anionic surfactants is 0 to 10% by weight.

6. Detergent or soak according to claim 1, wherein the magnesium carbonate is 11 to 22% by weight.

7. Detergent or soak according to claim 1, wherein the magnesium oxide is 5 to 8% by weight.

8. Detergent or soak according to claim 1, wherein the magnesium carbonate is 5 to 8% by weight.

9. Detergent or soak according to claim 1, wherein the non-ionic surfactants are 4 to 20% by weight.

10. Powdered detergent or soak particularly for use in one of a preliminary and main washing cycle of household machines and laundry machines for washing in a phosphate-free wash liquor, which detergent forms with water an acid wash liquor with a pH of 1–4, and contains one or more solid or pseudo-solid acids, in addition to wash-active substances, characterized in that the detergent contains powdered portions, by means of which the acid wash liquor is neutralized or alkalized substantially or completely by itself within a period of about 2 to 25 minutes, and that these portions comprise one or more alkali-supplying substances from the group: sodium metasilicate, soda, water-glass, calcium oxide, magnesium oxide, magnesium oxychloride, calcium carbonate and magnesium carbonate, which substances are at least partly coated with a non-ionic surfactant wherein the detergent or soak specifically includes as at least part of the alkali-supplying substance 8–25% by weight magnesium carbonate, 0–13% by weight magnesium oxide and 0–20% by weight calcium carbonate.

* * * * *